US007869727B2

(12) United States Patent
Kobayashi et al.

(10) Patent No.: US 7,869,727 B2
(45) Date of Patent: Jan. 11, 2011

(54) IMAGE FORMING APPARATUS WITH CONTROL SECTION TO CONTROL DEVELOPMENT BIAS POTENTIAL

(75) Inventors: Kazutoshi Kobayashi, Tokyo (JP); Yutaka Miyasaka, Tokyo (JP); Nobuyasu Tamura, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 65 days.

(21) Appl. No.: 12/369,992

(22) Filed: Feb. 12, 2009

(65) Prior Publication Data

US 2009/0208230 A1 Aug. 20, 2009

(30) Foreign Application Priority Data

Feb. 15, 2008 (JP) ..... 2008-034482

(51) Int. Cl.
*G03G 15/08* (2006.01)

(52) U.S. Cl. ..... 399/55; 399/48

(58) Field of Classification Search ..... 399/48, 399/53, 55, 49
See application file for complete search history.

(56) References Cited

U.S. PATENT DOCUMENTS 5,270,783 A * 12/1993 Bisaiji et al. ..... 399/48 X
5,298,943 A * 3/1994 Ide et al. ..... 399/48 X
5,619,308 A * 4/1997 Kinoshita et al. ..... 399/48
6,058,275 A 5/2000 Kodama
7,257,338 B2 8/2007 Yoshida
2002/0028082 A1 * 3/2002 Hisano et al. ..... 399/38
2009/0041487 A1 * 2/2009 Shida ..... 399/50

FOREIGN PATENT DOCUMENTS

JP 10-198159 A 7/1998
JP 2005-208147 A 8/2005
JP 2005-238528 A 9/2005
JP 2006-126747 A 5/2006
JP 2006-284966 A 10/2006

OTHER PUBLICATIONS

Japanese Office Action for Japanese Patent Application No. 2008-034482 mailed Jan. 12, 2010 with English translation.

* cited by examiner

*Primary Examiner*—Sophia S Chen
(74) *Attorney, Agent, or Firm*—Cantor Colburn LLP

(57) ABSTRACT

High quality images are provided by controlling development conditions based on the proportion of the toner layer potential difference, which a difference between the toner layer potential and electrostatic latent image potential, to the development contrast potential difference, which is a difference between the development bias potential and electrostatic latent image potential. The control section for controlling a development power supply controls the voltage supplied by the development power supply, based on the toner layer potential difference and development contrast potential difference in the development section. This arrangement ensures formation of high-quality images free from concentration of toner.

11 Claims, 11 Drawing Sheets

IMAGE FORMING APPARATUS WITH CONTROL SECTION TO CONTROL DEVELOPMENT BIAS POTENTIAL

This application is based on Japanese Patent Application No. 2008-034482 filed on Feb. 15, 2008 in Japanese Patent Office, the entire content of which is hereby incorporated by reference.

TECHNICAL FIELD

The present invention relates to an image forming apparatus for forming an image on a sheet with toner.

BACKGROUND

The image forming apparatus using electrophotographic method forms an electrostatic latent image on a photoreceptor (image carrying member), and develops the electrostatic latent image with toner in a development section, whereby an image is formed on a recording sheet.

In recent years, the image forming apparatus using electrophotographic method has been desired to meet the requirements for higher quality. To meet the requirements for higher quality, the electrostatic latent image formed on a photoreceptor must be reproduced faithfully with toner.

Various techniques have been disclosed for this purpose. For example, the technique disclosed in the Japanese Unexamined Patent Application Publication No. H10-198159 controls the development conditions based on the result of measuring the amount of toner charge prior to transfer. In the technique disclosed in the Japanese Unexamined Patent Application Publication No. 2005-208147, the amount of toner charge is calculated from the development current value having been detected, and an appropriate development bias is realized by correction based on the result of this calculation.

SUMMARY

However, the aforementioned conventional techniques are insufficient for faithfully reproducing with toner electrostatic latent images formed on the photoreceptor. The following describes the details of this fact with reference to FIG. 11:

FIG. 11 is an explanatory diagram showing the potential and others of a predetermined electrostatic latent image formed on the photoreceptor. The above-mentioned predetermined electrostatic latent image preferably is formed by a predetermined amount of exposure and has a shape having a predetermined width in the direction perpendicular to the moving direction of the photoreceptor.

Vi of FIG. 11 denotes the potential (potential on the photoreceptor after exposure) of a predetermined electrostatic latent image formed on the photoreceptor, Vt indicates the toner layer potential of the predetermined electrostatic latent image having been developed using the toner, and Vdc represents the DC bias value applied to the development section when the predetermined electrostatic latent image is developed with toner. In the following description, Vt−Vi indicates the toner layer potential difference A and Vdc−Vi denotes the development contrast potential difference B.

The toner on the development section is moved to the photoreceptor by the development contrast potential difference B, and is deposited on the photoreceptor. We found that, if there is a big difference between the toner layer potential difference A after development with toner, and the development contrast potential difference B, a wraparound electric field occurs at the edge portion of the toner deposited on the photoreceptor. This is highly likely to cause an image defect wherein development with toner is concentrated on the edge portion and the density on the edge portion is increased (this image defect is called concentration of toner). To be more specific, we found that this problem of concentration of toner fails to achieve a faithful reproduction of the electrostatic latent image on the photoreceptor using toner.

In the technique of controlling the development conditions based on the amount of toner charge as disclosed in Japanese Unexamined Patent Application Publication No. H10-198159 and Japanese Unexamined Patent Application Publication No. 2005-208147, the development conditions are not controlled by grasping the difference between the toner layer potential difference A and the development contrast potential difference B. Accordingly, this technique has not been sufficiently effective in solving the problem of concentration of toner. Vi of FIG. 11 varies greatly depending on the environment where an image forming apparatus is installed and the process how it has been used. For example, the variation of Vi causes fluctuation of as much as 10 through 20% in the development contrast potential difference B, depending on the environment and conditions of usage. This suggests that requirements for high image quality cannot be satisfied unless the development conditions are controlled by giving considerations to Vi.

An object of the present invention is to provide an image forming apparatus that realizes high image quality by renewing development conditions based on the ratio of the toner layer potential difference to the development contrast potential difference.

In view of forgoing, one embodiment according to one aspect of the present invention is an image forming apparatus, comprising:

an image carrier;

a development section which is configured to develop by toner an electric latent image formed on the image carrier into a visible image;

a power supply which is configured to supply a development bias potential to the development section;

an electrostatic latent image pattern potential measuring section which is configured to measure a potential of a predetermined electrostatic latent image pattern formed on the image carrier;

a toner layer potential obtaining section which is configured to obtain, as a toner layer potential, a potential of toner of a visible image formed by developing the predetermined electrostatic image pattern with toner in the development section; and a control section which is configured to control the power supply, wherein the control section controls the power supply to set a condition of the development bias potential based on a toner layer potential difference which is a difference between the toner layer potential and the electrostatic latent image pattern potential, and on a development contrast potential difference which is a potential difference between the development bias potential and the electrostatic latent image pattern potential.

According to another aspect of the present invention, another embodiment is an image forming method, comprising the steps of:

supplying a development bias potential to a development section which contains toner for development;

forming a predetermined electrostatic latent image pattern on an image carrier;

measuring a potential of the predetermined electrostatic latent image pattern formed on the image carrier;

developing the predetermined electrostatic latent image pattern with toner in the development section into a visible image;

obtaining, as a toner layer potential, a potential of toner of the visual image; and setting a condition of a development bias potential based on a toner layer potential difference which is a potential difference between the toner layer potential and the electrostatic latent image pattern potential, and on a development contrast potential difference which is a potential difference between the development bias potential and the electrostatic latent image pattern potential.

DETAILED DESCRIPTION OF THE PREFERRED EMBODIMENT

Overview of Image Forming Apparatus

Figure 1:
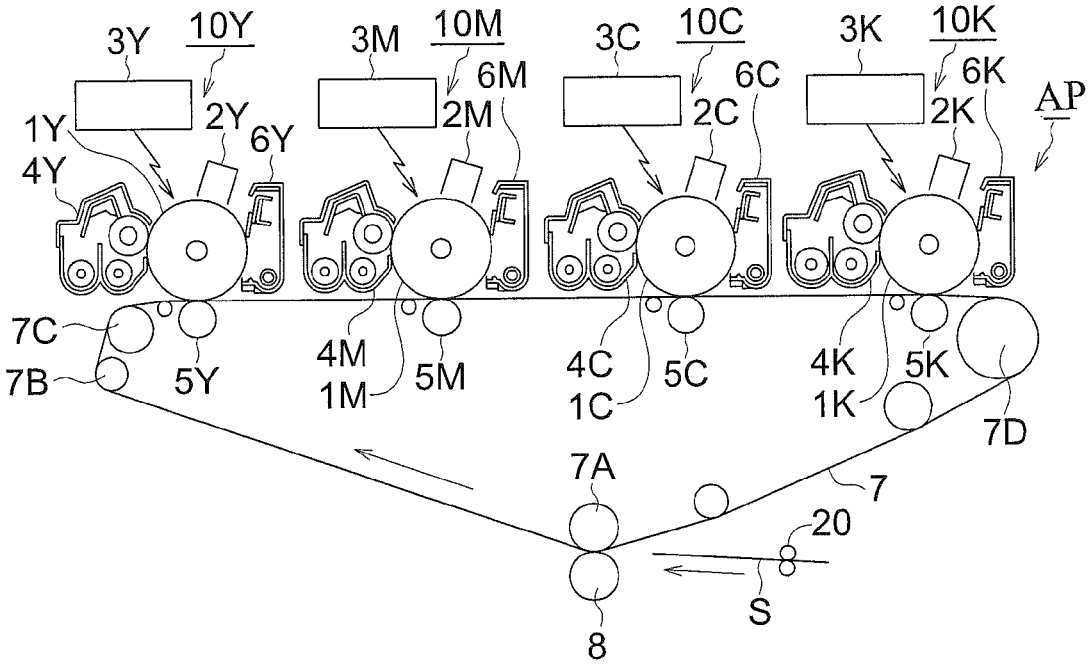
FIG. 1 is a schematic view representing an image forming apparatus of the present invention.

FIG. 1 is a schematic view representing an image forming apparatus of the present invention.

An image forming apparatus AP is designed in such a way that an image forming unit is arranged in the lateral direction.

The image forming apparatus AP is referred to as a tandem type image forming apparatus, and includes image forming units 10Y, 10M, 10C and 10K, a belt-like intermediate transfer unit 7, paper feed/conveyance apparatus (not illustrated), and fixing apparatus.

In the image forming apparatus AP, the intermediate transfer units 7 is arranged in the horizontal direction, and the image forming units 10Y, 10M, 10C and 10K are arranged in the lateral direction.

The image forming unit 10Y forming a yellow image includes a charging section 2Y, exposure section 3Y, development section 4Y, transfer section 5Y, and cleaning section 6Y arranged around the photoreceptor (image carrying member) 1Y. The image forming unit 10M forming a magenta image includes a photoreceptor 1M, charging section 2M, exposure section 3M, development section 4M, transfer section 5M, and cleaning section 6M. The image forming unit 10C forming a cyan image includes a photoreceptor 1C, charging section 2C, exposure section 3C, development section 4C, transfer section 5C, and cleaning section 6C. The image forming unit 10K forming a black image includes a photoreceptor 1K, charging section 2K, exposure section 3K, development section 4K, transfer section 5K, and cleaning section 6K. Thus, the photoreceptors 1Y, 1M, 1C and 1K, and development sections 4Y, 4M, 4C and 4K are designed to oppose to each other in a one-to-one relationship.

The intermediate transfer unit 7 is wound around a plurality of rollers 7A, 7B, 7C, 7D, and is rotatably supported.

The color images formed by the image forming units 10Y, 10M, 10C and 10K are sequentially transferred onto the rotating intermediate transfer unit 7 by the transfer sections 5Y, 5M, 5C and 5K (primary transfer) being superimposed on the intermediate transfer unit 7, and whereby a color image is formed. The sheet S stored in an unillustrated sheet feed cassette is fed by an unillustrated sheet feed/conveyance apparatus and is fed to a secondary transfer section 8 through a registration roller 20. Then the color image is transferred onto the sheet S (secondary transfer). The sheet S with the color image transferred thereon is subjected to a fixing process by an unillustrated fixing apparatus being sandwiched by an unillustrated ejection roller, and is placed on an unillustrated ejection tray outside the machine.

After the color image was transferred onto the sheet S by the secondary transfer section 8 and the sheet S was separated from the intermediate transfer unit 7, the remaining toner is removed by an unillustrated cleaning section.

The image forming apparatus AP of the present embodiment uses an electrophotographic process to form a color image on the sheet S. However, an image forming apparatus of the present invention can be an image forming apparatus only for monochrome images without being restricted to the present embodiment.

<Periphery of the Development Section>

Figure 2:
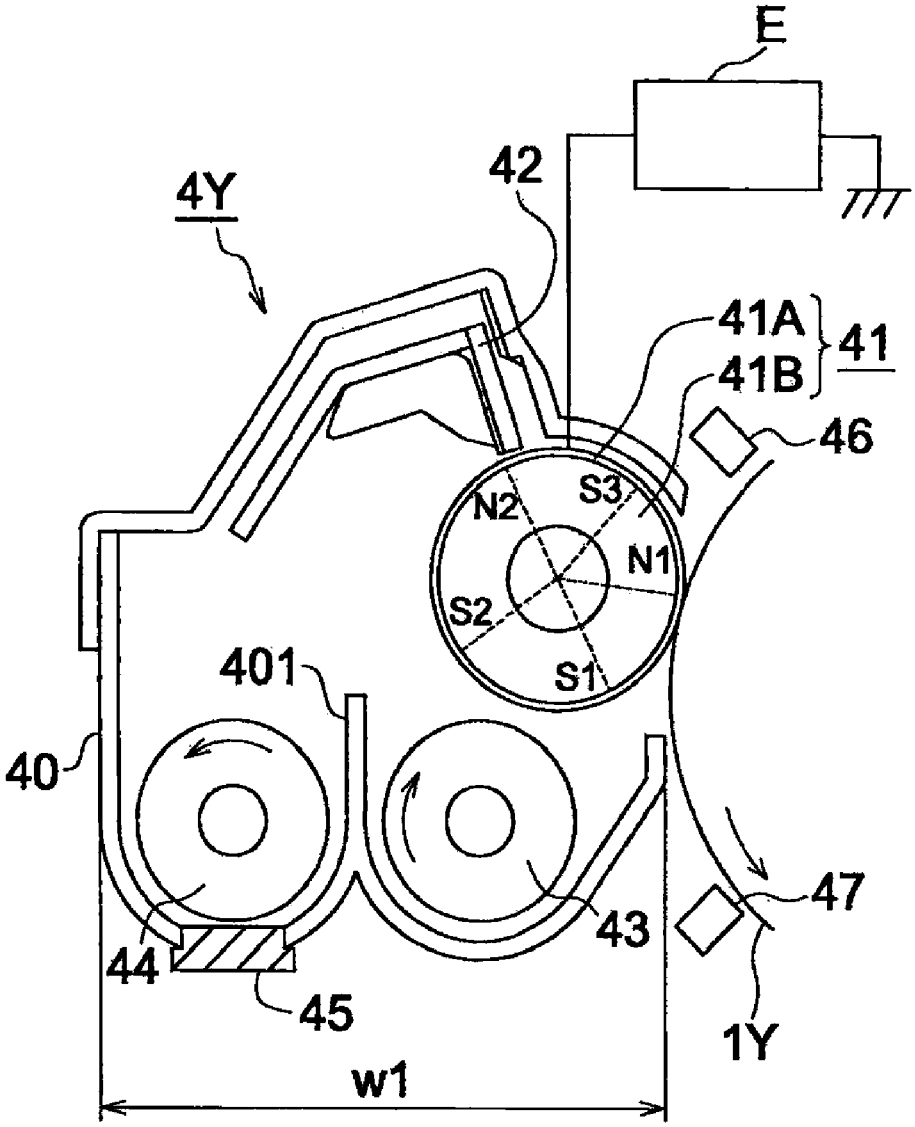
FIG. 2 is an enlarged cross sectional view showing the periphery of a development section.

FIG. 2 is an enlarged cross sectional view showing the periphery of the development section.

The development sections 4Y, 4M, 4C and 4K in the image forming apparatus AP are designed in almost the same structure. The following describes the details of the development section 4Y:

The development section 4Y includes a development section frame member 40, development roller 41, regulating member 42, supply screw 43 and stirring screw 44.

The development section frame member 40 is made up of an enclosure having a width of w1. The development roller 41, supply screw 43, and stirring screw 44 are rotatably incorporated in the development section frame member 40. Further, the regulating member 42 is also held by the development section frame member 40. The supply screw 43 and stirring screw 44 are installed on each side of a partition plate 401 rising upright from the bottom of the development section frame member 40.

The development roller 41 includes a development sleeve 41A and a fixed magnetic pole member 41B. The development roller 41 is installed above the supply screw 43, and this arrangement avoids an increase in the width w1 of the development section frame member 40 and an increase in the lateral direction of the image forming apparatus AP.

An AC voltage and DC voltage are superimposed on the development sleeve 41A as development bias by a development power supply E (power supply section). The development sleeve 41A rotates in the clockwise direction, and the outer diameter of the development sleeve 41A is 25 mm, for example. The rotational speed of the development sleeve 41A is 300 rpm at the time of image formation.

The fixed magnetic pole member 41B is fixed inside the development sleeve 41A, and includes five magnetic pole N1, N2, S1, S2 and S3. The magnetic pole N1 is a development pole, and the magnetic pole N2 is a regulating pole. A stripping magnetic pole S1 as the first repulsive magnetic pole and a scooping magnetic pole S2 as the second repulsive magnetic pole located adjacent to each other have the same polarity, and a repulsive pole is formed by two magnetic poles S1 and S2. The stripping magnetic pole S1 is formed upstream in the rotating direction of the development roller 41, and the scooping magnetic pole S2 is formed downstream. The magnetic pole S3 is a conveyance pole. The five magnetic poles of the fixed magnetic pole member 41B are formed in the direction of the development roller 41 in the order of the development pole N1, stripping magnetic pole S1, scooping magnetic pole S2, regulating pole N2, conveyance pole S3.

The fixed magnetic pole member 41B is mounted on the development section frame member 40 at the angle where the center of the magnetic line of the development pole N1 is heading to the development region formed on the photoreceptor 1Y.

The regulating member 42 regulates the amount of developer on the development sleeve 41A. The regulating member 42 is installed in the vicinity of the regulating pole N2 of the fixed magnetic pole member 41B, and a predetermined amount of developer is fed to the position opposed to the photoreceptor 1Y through the regulating member 42.

The supply screw 43 supplies developer to the development roller 41 while conveying the developer in the direction of rotary axis, and collects the developer completing the role of development from the development roller 41, and the developer is fed into the stirring screw 44.

The stirring screw 44 is arranged parallel to the supply screw 43, and mixes and stirs new toner supplied from an unillustrated toner replenishment section and the developer flowing back from the development sleeve 41A through the supply screw 43. The mixture is then conveyed to the upstream side of the supply screw 43.

Both the supply screw 43 and stirring screw 44 are the screw members formed in a helical structure.

A toner density detecting sensor 45 is provided in the vicinity of the stirring screw 44. The stirring screw 44 rotates when the toner density sensor 45 tries to detect the toner density in the development section 4Y. The toner density detecting sensor 45 applies a predetermined voltage to the coil and reads the output value of the current change depending on the change in permeability of the developer. Then the toner density inside the development section 4Y is identified from the output value.

A potential sensor 46 (potential measuring section) for measuring the potential of the electrostatic latent image formed on the photoreceptor 1Y is installed upstream, in the rotating direction of the photoreceptor 1Y, from the development section 4Y. The development conditions of the development section 4Y (e.g., frequency of AC bias applied by the development power supply) are adjusted based on the result of measurement by the potential sensor 46. Further, the toner layer potential sensor 47 for measuring the toner layer potential after the development of the electrostatic latent image formed on the photoreceptor 1Y with toner is installed downstream, in the rotating direction of the photoreceptor 1Y, of the development section 4Y, and the potential of the toner deposited on the photoreceptor 1Y is directly measured.

<Structure of Controlling the Image Forming Apparatus AP>

Figure 3:
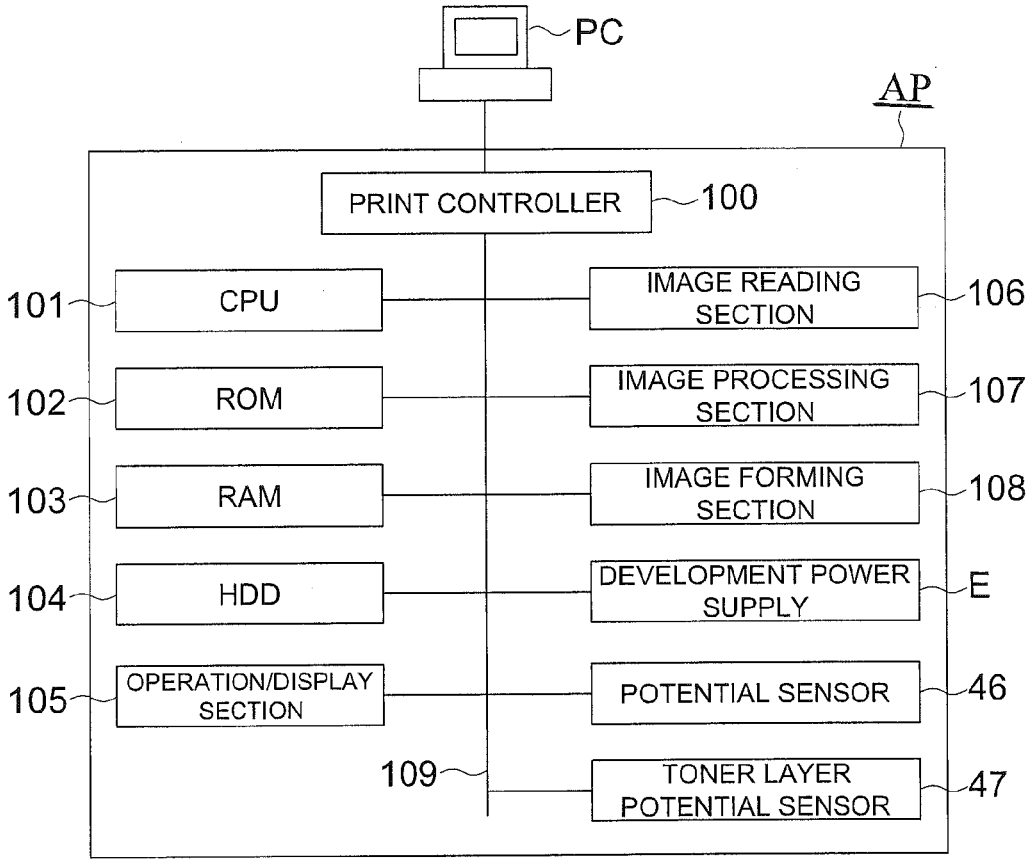
FIG. 3 is a block diagram showing a control system of the image forming apparatus.

FIG. 3 is a block diagram showing a control system of the image forming apparatus AP. It shows a representative control configuration.

A print controller 100 serves as an interface to a PC. A CPU 101 provides an overall control of the operations of the image forming apparatus AP and is connected to a ROM (Read Only Memory) 102 and RAM (Random Access Memory) 103 and others via a system bus 109. This CPU 101 reads out various control programs from the ROM 102 to load it in the RAM 103, and controls the operations of various sections. Further, the CPU 101 executes various forms of processing according to the program loaded in the RAM 103, stores the result of the processing in the RAM 103, and displays it on an operation/display section 105. Then, the result of the processing stored in the RAM 103 is saved in a predetermined storage. In the present embodiment, the CPU 101 constitutes a control section through collaboration with the ROM 102 and RAM 103.

The recording medium ROM 102, which stores the program and data, is made up of a magnetic of optical recording medium or semiconductor memory.

The RAM 103 provides a work area for temporarily storing the data processed by the various control programs executed by the CPU 101.

An HDD 104 stores the data of document images having been read by an image reading section 106 and image data having been outputted. It is structured in such a way that metallic disks with a magnetic substance coated thereon or deposited thereon are stacked at certain intervals. This is rotated at a high speed by a motor and magnetic heads are moved close thereto, and whereby data is read and written.

The operation/display section 105 allows various forms of setting to be set. The operation/display section 105 is designed, for example, as a touch panel type. The user inputs data through the operation/display section 105, and whereby conditions on color printing and monochromatic printing are set. Further, various forms of information such as network setting information can be displayed on the operation/display section 105.

The image reading section 106 optically reads document images and converts them into electric signal. The image data having brightness information of 10 bits for each color of RGB per pixel is generated when color originals are read in.

The image data generated by the image reading section 106, and the image data sent from the personal computer connected to the image forming apparatus AP are subjected to image processing by an image processing section 107. When the image forming apparatus AP is used for color printing, the image data of R (Red), G (Green), and B (Blue) generated by the image reading section 106 and others is inputted into a color conversion LUT of the image processing section 107, wherein the R, G and B data are color-converted into the image data of Y (yellow), M (magenta), C (Cyan) and Bk (Black). The color-converted image data is subjected to a grayscale reproduction correction processor to a screen process such as a dot process with reference to the density correction LUT. Alternatively, this image data is subjected to an edge processing for fine line enhancement.

An image forming section 108 made up of the image forming units 10Y, 10M, 10C, and 10K and the intermediate transfer unit 7 receives the image data having been image-processed by the image processing section 107, and forms an image on a sheet S.

Using the results of measurements by the potential sensor 46 and toner layer potential sensor 47, the CPU 101 controls the development power supply E according to a predetermined program. This procedure enables an image to be formed under appropriate development conditions.

<Concentration of Toner>

Referring to FIG. 11, the following again describes the toner gathering: Vi of FIG. 11 indicates the potential (potential on the photoreceptor after exposure) of a predetermined electrostatic latent image formed on the photoreceptor 1Y. Vt denotes the toner layer potential after a predetermined electrostatic latent image has been developed with toner. Vdc represents the DC bias value applied to the development section when a predetermined electrostatic latent image is developed with toner. In the following description, Vt−Vi defines a toner layer potential difference A, and Vdc−Vi defines a development contrast potential difference B.

Figure 11:
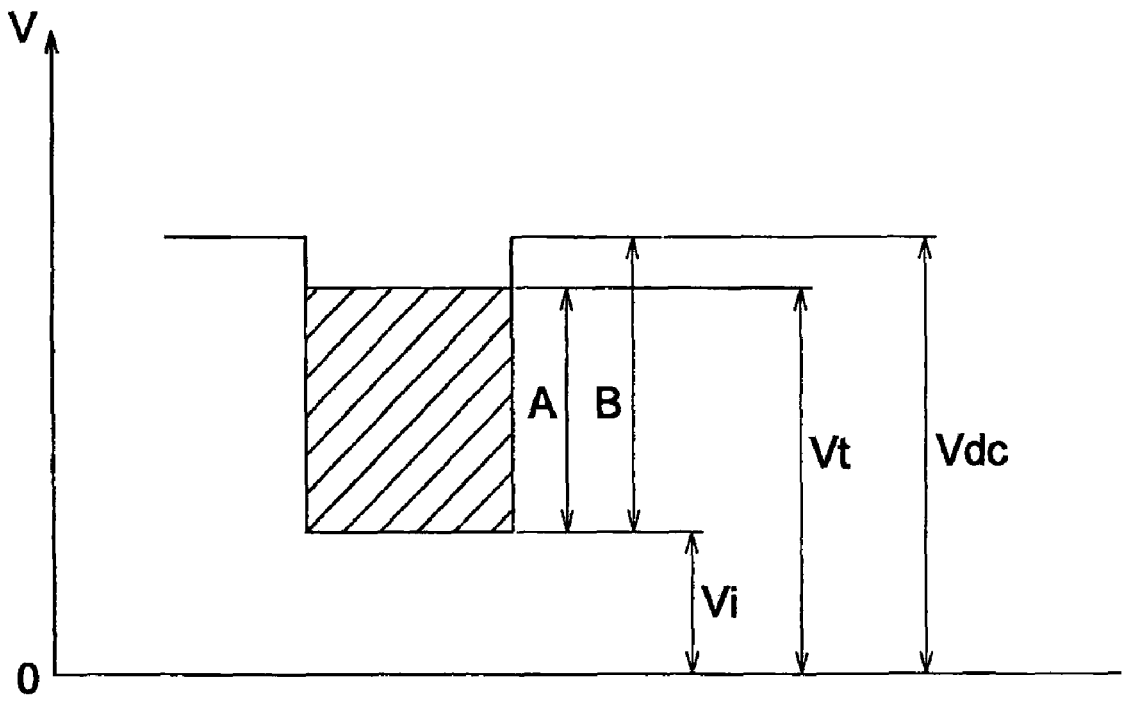
FIG. 11 is an explanatory diagram showing the potential of a predetermined electrostatic latent image formed on the photoreceptor.

If a predetermined electrostatic latent image shown in FIG. 11 is formed on the photoreceptor 1Y, toner of the development section 4Y is transferred to the photoreceptor 1Y by the development contrast potential difference B, and is deposited on the photoreceptor 1Y. If there is a big difference between the toner layer potential difference A after to development with toner and the development contrast potential difference B, a wraparound electric field occurs at the edge portion of the image of the toner deposited on the photoreceptor. As a result, there is a high possibility that the edge portion is intensively developed with toner, and concentration of toner occurs, where there is an increase in density (concentration of toner) at the edge portion.

As a method to grasp the concentration of toner, there is a method which uses only the proportion of Vdc to Vt without giving consideration to Vi. However, Vi varies greatly due to the environment where the image forming apparatus AP is installed, and the process how the image forming apparatus AP has been used. For this reason, this method of using only Vdc and Vt is not preferred. This will be explained below.

For example, the image forming apparatus AP was placed under the condition of high temperature and high humidity (e.g., 30° C. with a relative humidity of 80%), and the Vdc and others were measured. The measurements were Vdc=450V, Vt=380V and Vi=100V. After that, the environment was changed to make the image forming apparatus AP be placed under the conditions of low temperature and low humidity (e.g., 10° C. with a relative humidity of 20%). The measurements were Vdc=550V, Vt=480V, Vi=200V. The proportion of the toner layer potential difference A to the development contrast potential difference B (A/B) was 0.8 in both environments without any change. However, the proportion of Vdc to Vt (Vdc/Vt) is different in two environments. Concentration of toner depends on the proportion of the toner layer potential difference A to the development contrast potential difference B, and there is no difference of concentration of toner between the two environments. If concentration of toner is estimated based only on the proportion of Vdc to Vt, there is supposed to be a difference in the occurrence of concentration of toner between the two environments, and it is impossible to grasp the concentration of toner accurately. This is because Vi varies depending on the environment (to put it more specifically, there is a difference in the range of 100 through 190 V depending on the environment), and the change is greater in the environment of low temperature and low humidity than an ordinary environment.

Therefore, when the proportion of the toner layer potential difference A to the development contrast potential difference B is acquired and considered to develop with toner under the condition where concentration of toner does not occur easily, a high-quality image can be formed. Accordingly, a study was made to find out the relationship between the proportion of the toner layer potential difference A to the development contrast potential difference B and the development conditions (frequency, etc.).

In the present invention, the proportion of the toner layer potential difference A to the development contrast potential difference B is defined as development efficiency X [%], and is calculated from the following formula:

$$X=A/B\times 100 \quad (1)$$

where A (toner layer potential difference)=Vt−Vi, and B (development contrast potential difference)=Vdc−Vi <Evaluation of Concentration of Toner for the Development Efficiencies and Frequencies>

In the first place, concentration of toner was evaluated for the relationships between the development efficiencies X and the frequencies of the AC bias applied to the development section 4Y. Evaluation was made based on the image formed on a sheet in five ranks from rank 1 to rank 5. Rank 1 indicates the poorest image where concentration of toner occurs the most frequently. The image is better with an increase of the ranking number. Rank 5 shows the best image where concentration of toner does not occur. Table 1 shows the results of evaluations for the development efficiencies and frequencies.

TABLE 1

| Development efficiency [%] | 6500 [Hz] | 6000 [Hz] | 5500 [Hz] | 5000 [Hz] | 4500 [Hz] | 4000 [Hz] | 3500 [Hz] |
|---|---|---|---|---|---|---|---|
| 100 | 5 | 5 | 5 | 5 | 5 | 5 | 5 |
| 95 | 4 | 4 | 4 | 4 | 5 | 5 | 5 |
| 88 | 3 | 3 | 4 | 4 | 4 | 5 | 5 |
| 82 | 3 | 3 | 3 | 3 | 4 | 4 | 4 |
| 75 | 2 | 2 | 2 | 3 | 3 | 4 | 4 |
| 68 | 1 | 1 | 2 | 3 | 3 | 3 | 4 |

Figure 4:
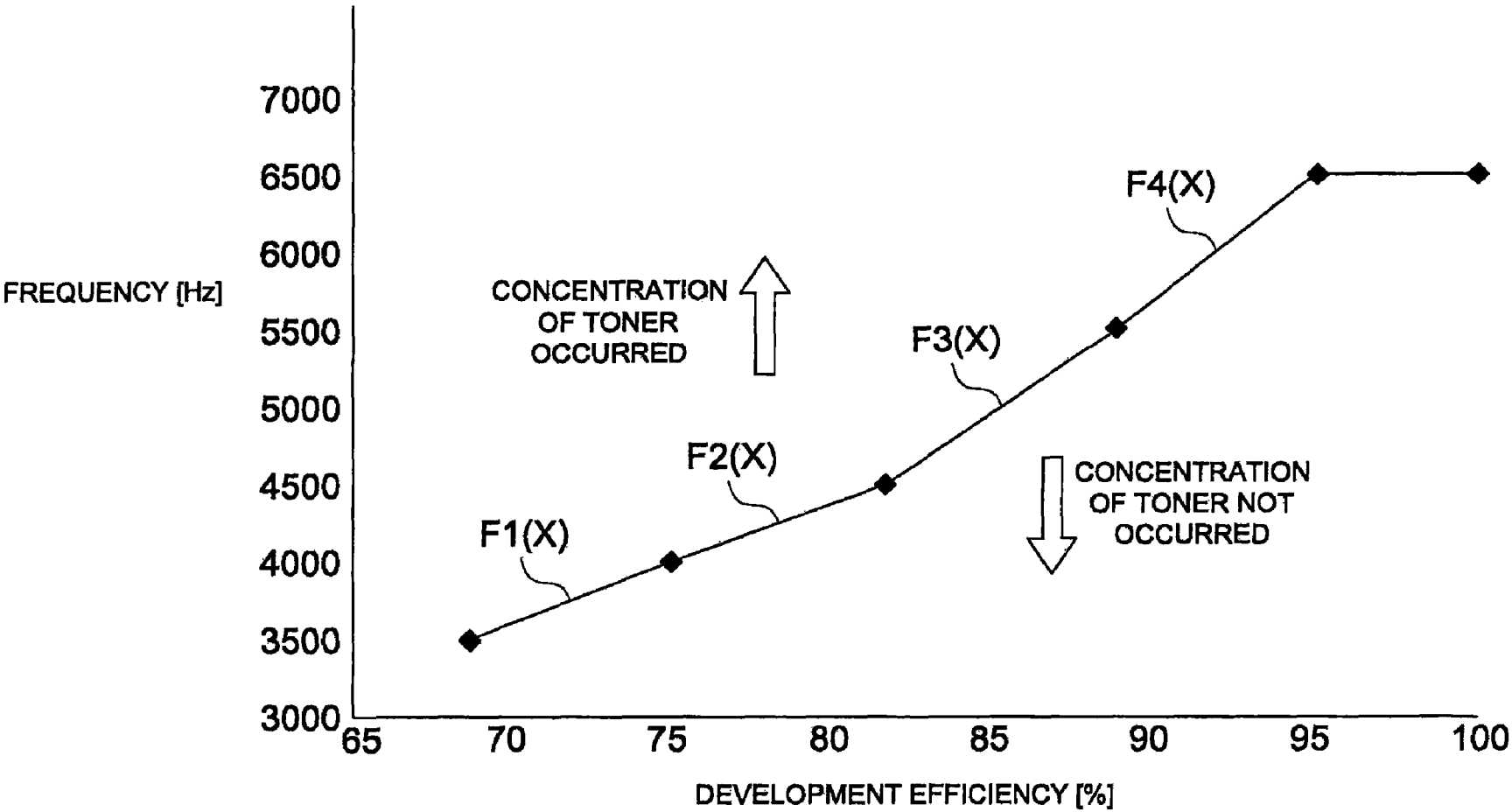
FIG. 4 is an explanatory diagram representing the relationship between development efficiency and frequency from the viewpoint of concentration of toner.

As shown in Table 1, the rank goes down as the development efficiency is reduced, and the image moves up the rank as the AC bias frequency is reduced. Regarding the images in the ranks 4 and 5 as images with no problem, the frequencies belonging to the rank 4 or higher were plotted against development efficiencies, and whereby the resulting relationship represented by the graph in FIG. 4 is obtained. Concentration of toner does not occur in the region on and below the line. Concentration of toner occurs in the region above the line.

A high-quality image can be formed by setting the AC bias frequency in the region where concentration of toner does not occur based on the development efficiency X calculated according to the relationship of FIG. 4. If the AC bias frequency is set lower, concentration of toner is accordingly hard to occur. However, the AC bias frequency set at a lower level may produce an image defect (e.g. fogging) other than concentration of toner. Therefore, the AC bias frequency is preferably set to the highest level in the region where concentration of toner does not occur. To be more specific, the AC bias frequency is preferably set to the frequency on the line of the chart in FIG. 4 or to the frequency in the vicinity of the line.

<Evaluation of Concentration of Toner for Development Efficiencies and Duty Ratios>

The concentration of toner was evaluated for the development efficiencies X, and the duty ratios of the AC bias applied to the development section 4Y.

Figure 5:
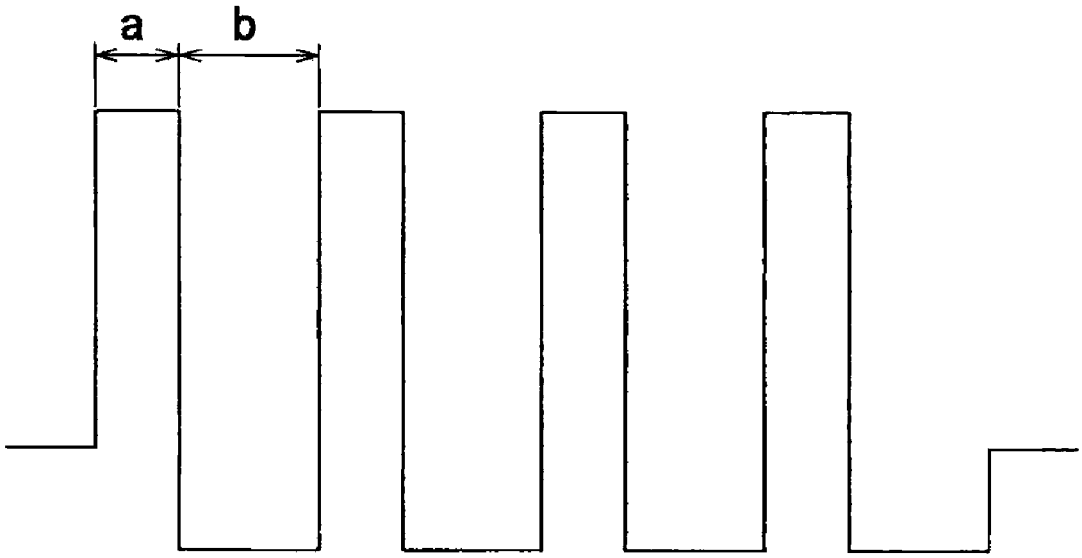
FIG. 5 is an explanatory diagram representing the waveform of an AC bias applied to the development section.

FIG. 5 is an explanatory diagram representing the AC bias waveform applied to the development section 4Y. The duty ratio in the present invention is defined as a/b of FIG. 5, where "a" denotes the time period when applying an electric field with the polarity by which toner is moved from the development sleeve 41A to the photoreceptor 1Y, and "b" indicates the time period when applying an electric field with the polarity by which toner is returned from the photoreceptor 1Y to the development sleeve 41A.

Table 2 shows the result of evaluating the concentration of toner for development efficiencies and duty ratios.

TABLE 2

| Development efficiency [%] | 50% | 40% | 30% | 20% |
|---|---|---|---|---|
| 100 | 5 | 5 | 5 | 5 |
| 95 | 4 | 4 | 4 | 5 |
| 88 | 3 | 4 | 4 | 5 |
| 82 | 3 | 3 | 4 | 4 |
| 75 | 2 | 2 | 3 | 4 |
| 68 | 1 | 2 | 3 | 4 |

As shown in Table 2, the evaluation result is lower in the ranks as the development efficiency is lower, and is higher in the ranks as the duty ratio is lower. Regarding the images in the rank 4 and rank 5 as images having no visual problem, and the duty ratios of rank 4 or higher were plotted against development efficiencies. The resulting relationship is graphically represented in FIG. 6. Concentration of toner does not occur in the region on and below the line. Concentration of toner occurs in the region above the line.

Figure 6:
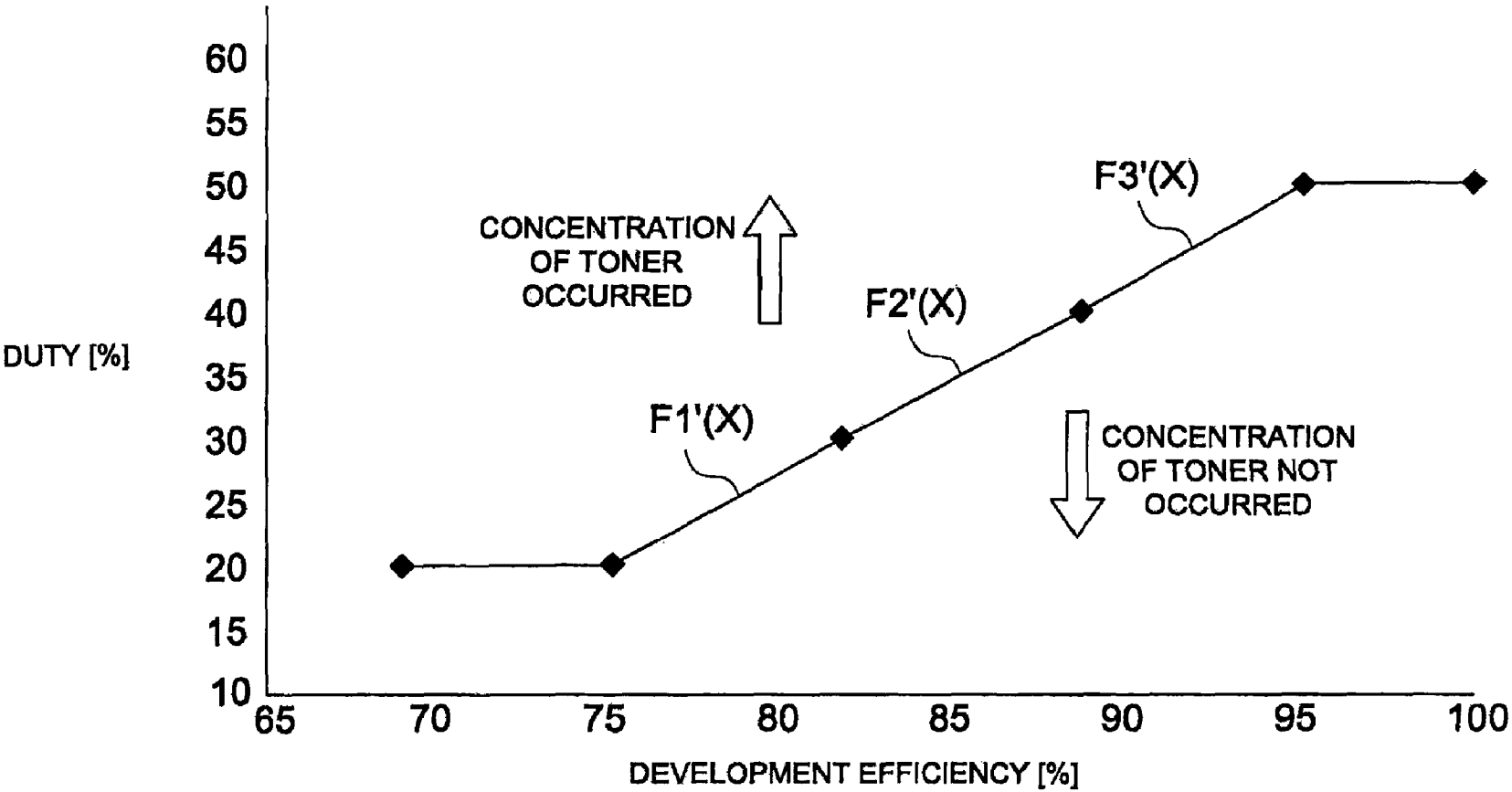
FIG. 6 is an explanatory diagram representing the relationship between the development efficiency and duty ratio from the viewpoint of concentration of toner.

A high-quality image can be formed by setting the duty ratio in the region where concentration of toner does not occur based on the development efficiency X calculated based on the relationship of FIG. 6. If the duty ratio is lower, the concentration of toner is accordingly hard to occur. However, the duty ratio set at a lower level may produce an image defect (e.g. fogging) other than concentration of toner. Therefore, the duty ratio is preferably set to the highest level in the region where concentration of toner does not occur. To be more specific, the duty ratio is preferably set to the frequency on the line of the chart in FIG. 6 or to the frequency in the vicinity of the line.

As described above, the relationship between the development efficiency X and the AC bias frequency applied to the development section 4Y, and the relationship between the development efficiency X and AC bias duty ratio applied to the development section 4Y have been acquired. Thus, the following describes the steps of forming a predetermined electrostatic latent image, calculating the development efficiency X and adjusting the frequency and duty ratio as development conditions to prevent concentration of toner from occurring.

<Frequency Adjusting Control Operation>

Figure 7:
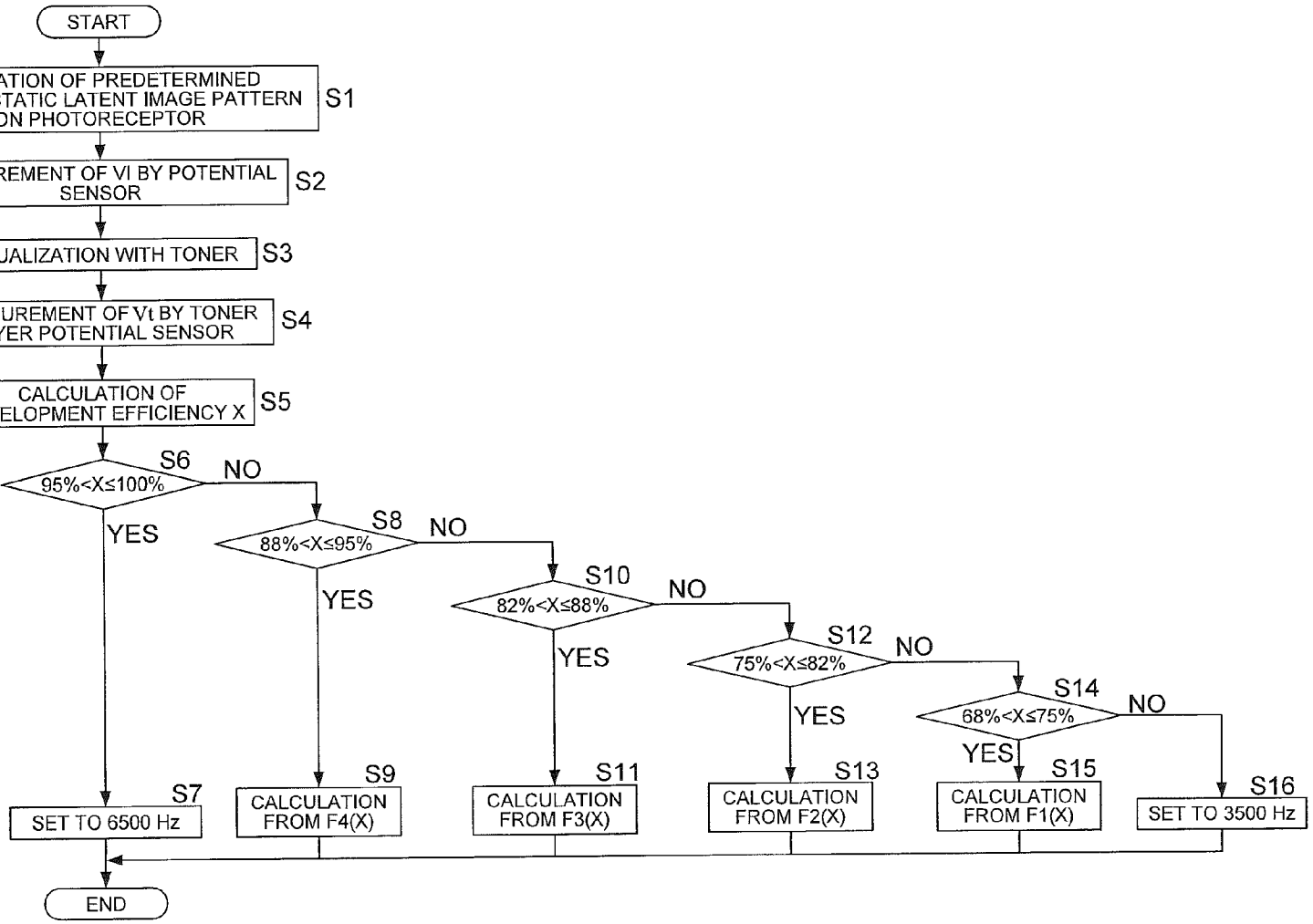
FIG. 7 is a flow chart representing the operation of setting the frequency of the AC bias by calculating the development efficiency.

FIG. 7 is a flow chart representing the operation of setting the AC bias frequency by calculating development efficiency.

Although the operations depicted in FIG. 7 are performed in each of the image forming units 10Y, 10M, 10C and 10K, the following describes the operations in the image forming unit 10Y as a representative example thereof:

In the first place, when the time is right to adjust the development conditions in the image forming apparatus AP (e.g. when turning on the image forming apparatus AP, having completed a predetermined number of printing, humidity having changed by 30% and more, or printing a sheet of a high page-coverage rate), a predetermined electrostatic latent image is formed on the photoreceptor 1Y (Step S1) by exposing the photoreceptor 1Y charged by a charging section 2Y with the exposure section 3Y.

When the predetermined electrostatic latent image has been formed on the photoreceptor 1Y, Vi is measured by the potential sensor 46 located at the upstream side from the development section 4Y (Step S2). The predetermined electrostatic latent image is developed by the toner in the development section 4Y (Step S3), and Vt is measured by the toner layer potential sensor 47 arranged at the downstream side from the development section 4Y (Step S4: the toner layer potential sensor 47 functions as a toner layer potential obtaining section in this case). Vi and Vt having been measured are stored in the RAM 103, and the DC bias value (Vdc) which is applied to the development section 4Y when the electrostatic latent imager is developed with toner is also stored in the RAM 103.

Upon completion of measurement of Vi and others, the development efficiency X is calculated by a predetermined program (Step S5). The development efficiency X is calculated from the aforementioned formula (1). Then the AC bias frequency in the region where concentration of toner does not occur is determined and set based on the development efficiency X having been calculated (Step S6 through S16). The frequency is determined using the result of the evaluation shown in FIG. 4. In the present embodiment, the frequency is determined so as to be located on the line of FIG. 4.

In the first place, a step is taken to determine whether or not the development efficiency X is greater than 95% without exceeding 100% (Step S6). If so (Step S6: Yes), the AC bias frequency is set to 6500 Hz (Step S7). If not (Step S6: No), a step is taken to determine whether or not the development efficiency X is greater than 88% without exceeding 95% (Step S8).

If the development efficiency X is greater than 88% without exceeding 95% (Step S8: Yes), the development efficiency X is substituted into the approximate expression F4(X) in the portion shown in FIG. 4 to calculate the frequency value and set the frequency (Step S9). The frequency set in Step S9 is in the range of 5500 Hz to 6500 Hz.

Similarly, if the development efficiency X is greater than 82% without exceeding 88% (Step S10: Yes), the development efficiency X is substituted into the approximate expression F3(X) in the portion shown in FIG. 4 to calculate the frequency value and set the frequency (Step S11). If the development efficiency X is greater than 75% without exceeding 82% (Step S12: Yes), the development efficiency X is substituted into the approximate expression F2(X) in the portion shown in FIG. 4 to calculate the frequency value and set the frequency (Step S13). Further, if the development efficiency X is greater than 68% without exceeding 75% (Step S14: Yes), the development efficiency X is substituted into the approximate expression F1(X) in the portion shown in FIG. 4 to calculate the frequency value and set the frequency (Step S15). If the development efficiency X is smaller than 68% (Step S14: No), frequency is set to 3500 Hz.

As described above, a high-quality image free from concentration of toner can be formed by setting the AC bias frequency applied to the development section 4Y based on the development efficiency X. By using the development efficiency X in which consideration is given to Vi, it is possible to select appropriate development conditions in which consideration is given to the environment where the image forming apparatus is installed and the process how the image forming apparatus has been used.

<Duty Ratio Adjusting Control Operation>

Figure 8:
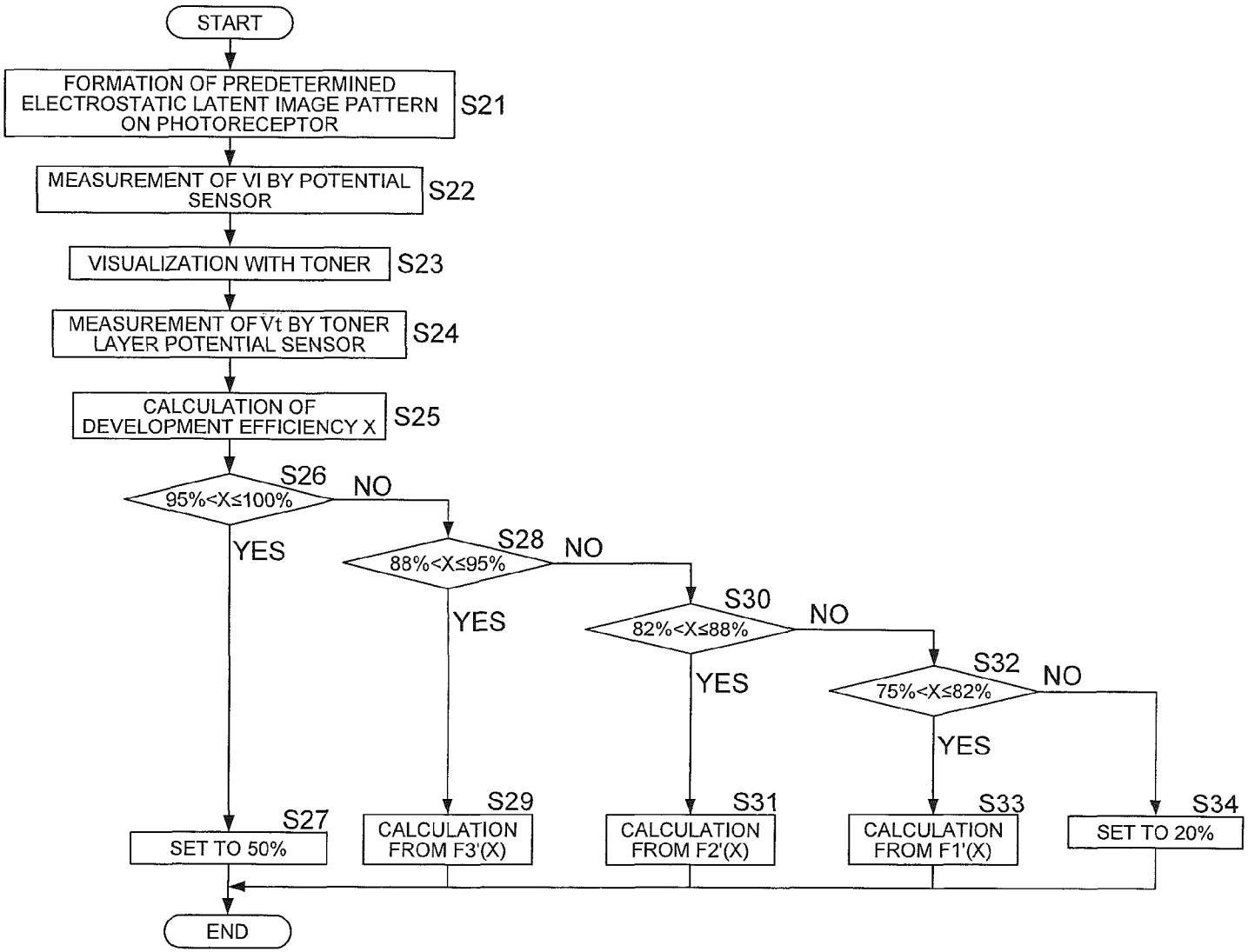
FIG. 8 is a flow chart representing the operation of setting the frequency of the AC bias frequency by calculating the development efficiency.

The following describes the procedure of adjusting the AC bias duty ratio: FIG. 8 is a flow chart representing the operation of setting the AC bias frequency by calculating the development efficiency.

In the first place, when the time is right to adjust the development conditions in the image forming apparatus AP, a predetermined electrostatic latent image is formed on the photoreceptor 1Y (Step S21).

When a predetermined electrostatic latent image has been formed on the photoreceptor 1Y, Vi is measured by the potential sensor 46 located at the upstream side from the development section 4Y (Step S22). The predetermined electrostatic latent image is developed with the toner in the development section 4Y (Step S23), and Vt is measured by the toner layer potential sensor 47 arranged at the downstream from the development section 4Y (Step S24).

Upon completion of measurement of the Vi and others, the development efficiency X is calculated by a predetermined program (Step S25) from the aforementioned formula (1). Then the AC bias duty ratio in the region where concentration of toner does not occur is determined and set based on the development efficiency X having been calculated (Step S26 through S34), where the duty ratio is determined using the result of evaluation shown in FIG. 6. In the present embodiment, the duty ratio is determined so as to be located on the line of FIG. 6.

In the first place, a step is taken to determine whether or not the development efficiency X is greater than 95% without exceeding 100% (Step S26). If so (Step S26: Yes), the AC bias duty ratio is set to 50% (Step S27). If not (Step S26: No), a step is taken to determine whether or not the development efficiency X is greater than 88% without exceeding 95% (Step S28).

If the development efficiency X is greater than 88% without exceeding 95% (Step S28: Yes), the development efficiency X is substituted into the approximate expression F3'(X) in the portion shown in FIG. 6 to calculate the duty ratio value and set the duty ratio (Step S29). The duty ratio set in Step S29 is in the range of 40 through 50%.

In the same way, if the development efficiency X is greater than 82% without exceeding 88% (Step S30: Yes), the development efficiency X is substituted into the approximate expression F2'(X) in the portion shown in FIG. 6 to calculate the duty ratio value and set the duty ratio (Step S31). If the development efficiency X is greater than 75% without exceeding 82% (Step S32: Yes), the development efficiency X is substituted into the approximate expression F1' (X) in the portion shown in FIG. 6 to calculate the duty ratio value and set the duty ratio (Step S33). Further, if the development efficiency X is smaller than 75% (Step S32: No), duty ratio is set to 20% (Step S34).

As described above, a high-quality image free from concentration of toner can be formed by changing the duty ratio of the AC bias applied to the development section 4Y based on the development efficiency X. Especially by using the development efficiency X with consideration given to Vi, it is possible to select appropriate development conditions with consideration given to the environment where the image forming apparatus is installed and the process how the image forming apparatus has been used.

<Control Operation for Calculating the Toner Layer Potential Vt from the Fluctuating Voltage Value>

Figure 9:
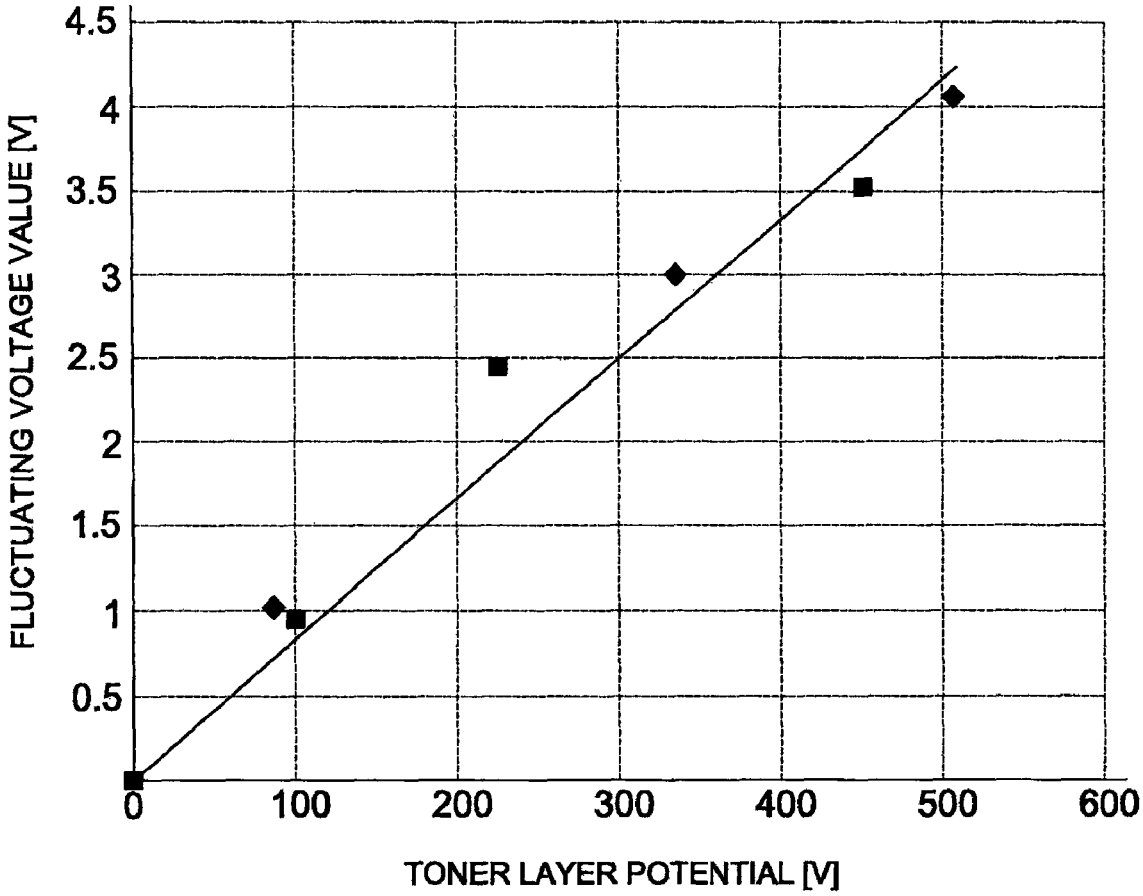
FIG. 9 is an explanatory diagram representing the relationship between the toner layer potential and fluctuating voltage value.

In the aforementioned procedure, the toner layer potential Vt was measured by using the toner layer potential sensor 47 (FIG. 2) located at the downstream from the development section 4Y. This requires a separate toner layer potential sensor 47 to be installed to measure the toner layer potential Vt. The following describes the method of calculating the toner layer potential Vt without installing a separate toner layer potential sensor 47:

The fluctuating voltage value Vit caused, between the both ends of the load error detection resistor located on a power supply cord connecting the development power supply E and the development sleeve, by the current generated when the toner moves from the development sleeve 41A to the photoreceptor 1Y. This toner movement affects the toner layer potential Vt. Thus, the present inventors have found out that there is a relationship between the fluctuating voltage value Vit and the toner layer potential Vt. The following studies the relationship between the fluctuating voltage value Vit and the toner layer potential Vt, and the result is given in FIG. 9.

The relationship between the fluctuating voltage value Vit and the toner layer potential Vt can be expressed by the following approximate expression:

$$Vt = Vit/(8.31\times10^{-3}) \quad (2)$$

For example, when the fluctuating voltage value Vit is 2.5V, the toner layer potential Vt is 300.8V. By using this approximate expression, the development efficiency X can be calculated, without having to measure the toner layer potential Vt directly by the toner layer potential sensor 47. The following approximate expression can be either a linear expression or a quadratic expression.

Figure 10:
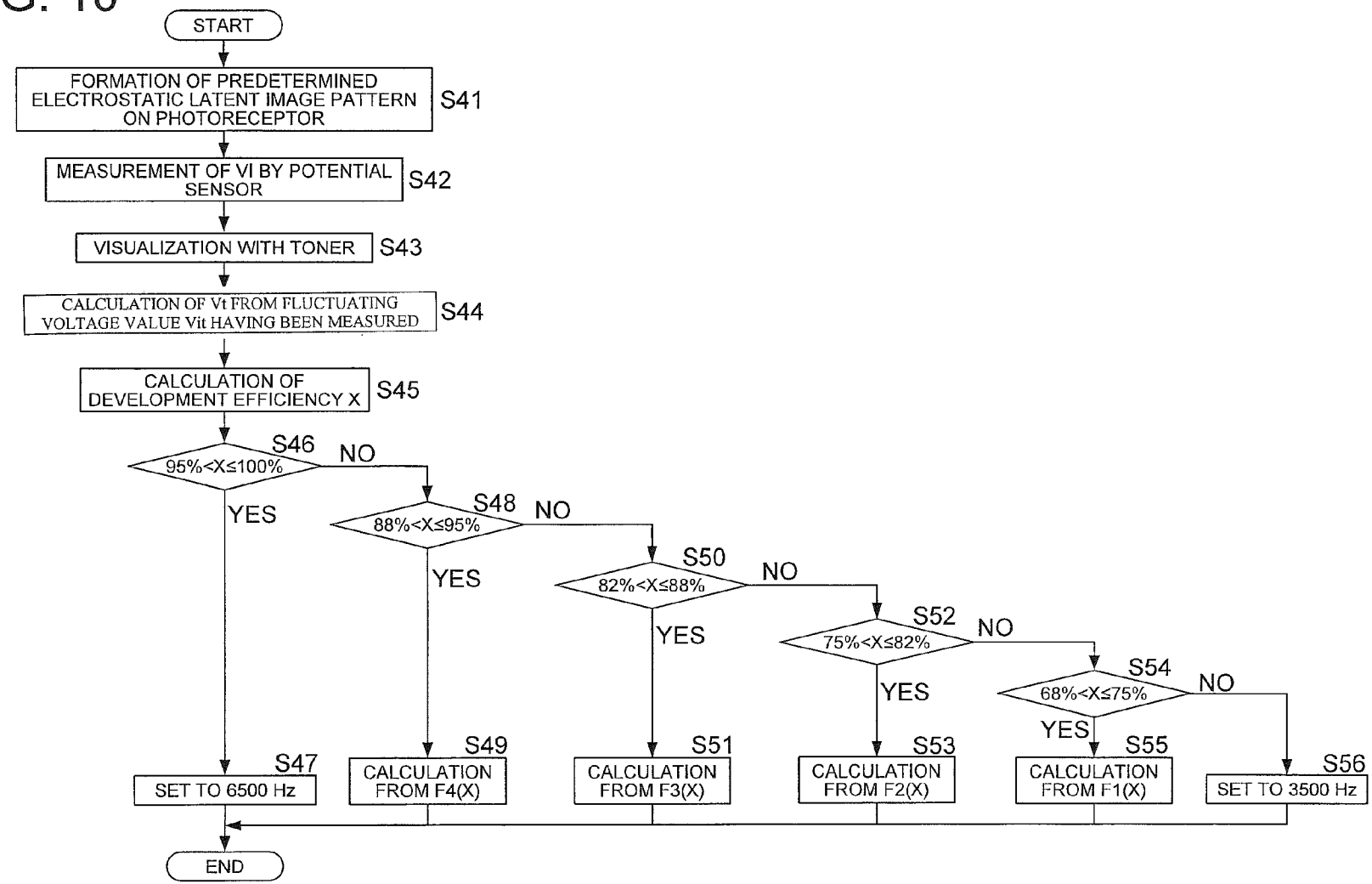
FIG. 10 is a flow chart representing the operation of setting the frequency by calculating the development efficiency through the use of Vt having been calculated.

FIG. 10 is a flow chart representing the operation of setting the frequency by calculating the development efficiency X by use of Vt having been calculated.

In the first place, when it is the right time to adjust the development conditions in the image forming apparatus AP, a predetermined electrostatic latent image is formed on the photoreceptor 1Y (Step S41).

When a predetermined electrostatic latent image has been formed on the photoreceptor 1Y, Vi is measured by the potential sensor 46 located upstream from the development section 4Y (Step S42). The predetermined electrostatic latent image is developed by the toner of the development section 4Y (Step S43). Then the fluctuating voltage value generated on the load error detection resistor for the development power supply E is measured, and Vt is calculated from the fluctuating voltage value Vit (Step S44). Vt is obtained from the aforementioned formula (2) (where the CPU 101 and others serve as the toner layer potential acquisition section).

Upon completion of measurement of Vi and others, the development efficiency X is calculated by a predetermined program (Step S45). The development efficiency X is calculated from the aforementioned formula (1). Then the AC bias frequency is determined, based on the development efficiency X having been calculated, to be in the region where concentration of toner does not occur, and the AC bias frequency is set (Step S46 through S56). The frequency is determined in the same manner as that shown in FIG. 7, and will not be described here to avoid duplication. Instead of setting the frequency from the development efficiency X, the AC bias duty ratio can be set from the development efficiency X, as shown in FIG. 8; alternatively, both the frequency and the duty ratio can be set.

As described above, when the toner layer potential Vt is calculated from the fluctuating voltage value on the load error detection resistor for the development power supply E, development efficiency X can be calculated, and the frequency and the duty ratio of the AC bias can be set without a toner layer potential sensor 47. This method allows the concentration of toner to be eliminated by the simple structure, and a high-quality image thus can be formed.

The image forming apparatus of the present invention provides high quality images by setting the development conditions such as frequency based on the proportion of the toner layer potential difference to the development contrast potential difference.

It is to be expressly understood, however, that the present invention is not restricted to the aforementioned embodiment. The present invention can be embodied in a great number of variations with appropriate modifications or additions, without departing from the technological spirit and the scope of the invention claimed.

What is claimed is:

1. An image forming apparatus, comprising:

an image carrier;

a development section which is configured to develop by toner an electric latent image formed on the image carrier into a visible image;

a power supply which is configured to supply a development bias potential to the development section;

an electrostatic latent image pattern potential measuring section which is configured to measure a potential of a predetermined electrostatic latent image pattern formed on the image carrier;

a toner layer potential obtaining section which is configured to obtain, as a toner layer potential, a potential of toner of a visible image formed by developing the predetermined electrostatic image pattern with toner in the development section; and a control section which is configured to control the power supply, wherein the control section controls the power supply to set a condition of the development bias potential based on a toner layer potential difference which is a difference between the toner layer potential and the electrostatic latent image pattern potential, and on a development contrast potential difference which is a potential difference between the development bias potential and the electrostatic latent image pattern potential.

2. The image forming apparatus of claim 1, wherein when the control section sets the condition of the development bias potential, the control section sets the condition based on a ratio of the toner layer potential difference to the development contrast potential difference.

3. The image forming apparatus of claim 1, wherein the toner layer potential obtaining section directly measures a potential of toner of the developed predetermined electrostatic latent image pattern on the image carrier to obtain the toner layer potential.

4. The image forming apparatus of claim 1, wherein the toner layer potential obtaining section measures a fluctuating voltage caused by transfer of toner from the development section to the image carrier when the predetermined electrostatic latent image pattern is developed with toner.

5. The image forming apparatus of claim 4, wherein the fluctuating voltage is caused, by an electric current accompanying the transfer of toner, on a resistor provided between the power supply and the development section.

6. The image forming apparatus of claim 1, wherein when the control section sets the condition of the development bias potential, the control section sets as the condition a frequency of the development bias potential.

7. The image forming apparatus of claim 1, wherein when the control section sets the condition of the development bias potential, the control section sets as the condition a duty ratio of the development bias potential.

8. An image forming method, comprising the steps of:

supplying a development bias potential to a development section which contains toner for development;

forming a predetermined electrostatic latent image pattern on an image carrier;

measuring a potential of the predetermined electrostatic latent image pattern formed on the image carrier;

developing the predetermined electrostatic latent image pattern with toner in the development section into a visible image;

obtaining, as a toner layer potential, a potential of toner of the visual image; and setting a condition of a development bias potential based on a toner layer potential difference which is a potential difference between the toner layer potential and the electrostatic latent image pattern potential, and on a development contrast potential difference which is a potential difference between the development bias potential and the electrostatic latent image pattern potential.

9. The method of claim 8, wherein in the step of setting a condition of a development bias potential, the development bias potential is set based on a ratio of the toner potential difference to the development contrast potential difference.

10. The method of claim 8, wherein in the step of setting a condition of a development bias potential, a frequency of the development bias potential is set as the condition.

11. The method of claim 8, wherein in the step of setting a condition of development bias potential, a duty factor of the development bias potential is set as the condition.

* * * * *